US006047657A

United States Patent [19]

Cox

[11] Patent Number: 6,047,657

[45] Date of Patent: Apr. 11, 2000

[54] SURFABLE WAVE MAKING DEVICE

[76] Inventor: Steve Jon Cox, 27021 Avenue Las Palmas, Capistrano Beach, Calif. 92624

[21] Appl. No.: 09/356,615

[22] Filed: Jul. 19, 1999

[51] Int. Cl.[7] ..... B63B 21/56

[52] U.S. Cl. ..... 114/242; 114/343

[58] Field of Search ..... 114/245, 244, 114/253, 343; 405/79; 441/65, 74

[56] References Cited

U.S. PATENT DOCUMENTS

| | | | |
|---|---|---|---|
| 5,664,910 | 9/1997 | Lochtefeld et al. | 114/274 |
| 5,860,766 | 1/1999 | Lochtefeld et al. | 114/253 |
| 5,911,190 | 6/1999 | Lochtefeld et al. | 114/274 |

*Primary Examiner*—Ed Swinehart
*Attorney, Agent, or Firm*—Stetina Brunda Garred & Brucker

[57] ABSTRACT

Apparatus for generating surfable waves. In a first preferred embodiment, the invention comprises a buoyant hull member designed to be towed by a conventional speedboat or other like watercraft. The hull member preferably has a generally chevron-like shape with elongate, forward-facing sides defined by contoured sidewall portions that produce tubular waves suitable for surfing when advanced through a body of water. Preferably, such hull member is comprised of first and second wave generating beams that are attached to one another via a hinge at the point of the chevron. In a second preferred embodiment, the invention comprises at least one, and preferably a pair of elongate wave generating beams that are detachably fastenable to opposed sides of a conventional speedboat or other similar watercraft. Each respective beam is designed to extend in a generally diagonal fashion rearward from the bow of such watercraft. When the beam or beams are advanced through a body of water, a surfable wave is generated thereby.

24 Claims, 2 Drawing Sheets

SURFABLE WAVE MAKING DEVICE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The sport of surfing is well known and has existed for centuries. Essentially, the sport comprises catching and riding waves whereby a surfer upon a surfboard, facing his body in the same direction as the motion of the wave, uses his arms to paddle until his momentum is equal to that of the waves'. The surfer, if possessing the requisite skill, then stands up upon the board and uses his balance and the shifting of his body weight to control his direction relative the direction of the wave.

Essential to the sport of surfing, however, are ocean waves that possess the requisite size, strength and speed to propel the surfer and surfboard forward. As is known, waves are created by a complex combination of wind and gravity. These factors manifest themselves, in part, by swells that spread out from storms, tide-generating forces created by the sun, moon and earth positions, and the specific direction of the current of the ocean in a given geographic location. As such, based upon this combination of forces, the surf in any given coastal area can vary dramatically from being completely "flat" to over 10 feet in some areas. Moreover, such surfing conditions are continuously in a state of flux, and may only be ideal for a few hours or a few days at a time.

While significant advances have been made with respect to predicting when surf conditions are most ideal for a given coastal area, the intensity and frequency of the waves in many coastal areas are currently incapable of being controllably produced and are thus entirely dependent upon the forces of nature. As such, surfers wishing to enjoy optimal surfing conditions must continuously monitor weather conditions and "surf reports" and further, typically have to forego surfing to the extent a given opportunity to surf under ideal conditions interferes with existing obligations, such as employment.

The drawbacks of unpredictable surfing conditions likewise can detract from surfing events and competitions. In this regard, it is frequently difficult to schedule events based around optimal surfing conditions insofar as the latter are elusive and cannot presently be controlled to coincide with the particular surfing event. As such, it is commonplace to have surfing contests and competitions under sub-optimal conditions that do not test the true ability of the competitors, nor illicit the commensurate level of spectator enthusiasm.

Additionally, because the sport of surfing is currently limited exclusively to coastal areas, such sport cannot be enjoyed in other bodies of water, namely, lakes and rivers, insofar as such bodies of water are incapable of producing surfable waves via natural forces. As such, a substantial portion of the population is effectively precluded from even having the opportunity to surf, and thus are practically prevented from enjoying and participating in such sport.

In light of such shortcomings, there is thus a need in the art for an apparatus that is capable of generating waves within a body of water of sufficient height and strength to enable the same to be surfed upon. There is additionally a need in the art for a wave generating apparatus that is capable of predictably producing and reproducing waves of varying magnitudes to accommodate novice to experienced surfers. There is still further a need in the art for a wave generating apparatus that can easily and efficiently generate surfable waves that is of simple construction, easy to utilize, relatively inexpensive to manufacture, is easily transportable and may be utilized repeatedly in any of a variety of bodies of water.

BRIEF SUMMARY OF THE INVENTION

The present invention specifically addresses and alleviates the above-identified deficiencies in the art. In this regard, the present invention is directed to a surfable wave generating apparatus that can selectively, controllably, and reproducibly generate surfable waves of varying dimensions upon a body of water. In a first preferred embodiment, the invention comprises a buoyant hull member that is designed to be towed within a body of water by a speedboat or other similar-type watercraft. The hull member has a generally chevron-like shape such that the tip or point defined by the chevron advances through the water in the direction in which the hull is towed. The elongate portions or arms of the chevron member comprise an elongate beams having contoured, forward-facing sides thereon. In a preferred embodiment, the forward-facing sides of each beam are characterized by a continuous sidewall having a generally concave, upwardly sloping oblique surface formed at the proximal end thereof that becomes progressively more concave and tubular as the sidewall defining the forward-facing surface extends distally. In a most preferred embodiment, each beam is further provided with a tapered, inwardly-curved sidewall portion formed upon the distal uppermost portion of the peripheral edge of the sidewall defining the forward-facing surface of each respective beam member.

In use, when the chevron-shaped hull member is pulled within a body of water, the water is caused to scoop and curl about such sidewall portion of each respective beam, which ultimately produces a pair of surfable waves from the respective opposed sides of the hull member. To enable a surfer to become optimally positioned upon a wave generated by the hull member of the present invention, there may optionally be provided one or more handle members formed upon each respective beam member defining the hull, which the surfer or surfers may utilize to grasp while the hull is being towed until such time as the surfer may wish to let go and surf upon the wave generated by the apparatus.

To facilitate the handling, storage and transportation of the hull member, it is contemplated that the elongate beams defining the chevron member may be attached to one another via a hinge disposed upon the central-most portion or point of the chevron defined thereby. In use, such hinge enables the elongate members to cooperate to define an angle ranging from 0°–180°. A locking mechanism is further provided to selectively and rigidly secure the elongate members at a specified angle relative one another, which is preferably approximately 90°. The hull member may further be provided with one or more floatation members or pontoons to facilitate stability and control of the hull member as the same is pulled horizontally across the surface of the water. Preferably, such floatation members or pontoons are formed as elongate members and attached to the elongate beams of the chevron hull member upon the bottom or rearwardly facing portions thereof.

In a second preferred embodiment, the invention comprises at least one, and preferably a pair of wave generating beams that are detachably fastenable to one or both sides of a conventional speedboat or other similar watercraft. As per the first embodiment, each respective beam member is provided with a forward-facing side characterized by continuous sidewall having a generally concave, upwardly sloping oblique surface formed at the proximal end thereof but becomes progressively more concave and tubular as the sidewall defining the forward-facing surface extends distally. As per the first embodiment, such elongate beam is further preferably provided with a tapered, inwardly-curved sidewall portion formed upon a distal uppermost portion of the peripheral edge of the sidewall defining the elongate beam's forward-facing surface. Such elongate beam or beams may further include a floatation or pontoon member, as per the first embodiment, and may likewise include a handle member which may be grasped by a surfer or surfers.

In use, when each respective beam is partially submerged in water and the boat to which such beam or beams are attached advances in a forward direction, a tubulartype wave is thus caused to be generated of sufficient strength and height such that the same may be surfed upon. Preferably, each respective wave generating beam is formed to extend rearwardly in a generally diagonal fashion relative the bow of such boat. Additionally, as per the first embodiment, each respective beam may be formed to have a particular length, height and contoured concave surface to produce waves of varying height.

It is therefore the object of the present invention to provide a wave generating apparatus capable of selectively and controllably producing surfable waves on a body of water.

Another object of the present invention is to provide a wave generating apparatus that enables surfable waves to be repeatedly generated having a desired height and intensity.

Another object of the present invention is to provide a wave generating apparatus that is simple to use, can be utilized in virtually any body of water and can be readily implemented with the use of conventional speedboats or other similar type watercraft.

Still further objects include providing a wave generating apparatus that is of simple design, easy and inexpensive to manufacture, and is exceptionally easy to store, transport and handle. It is additionally an object of the present invention to provide methods of generating surfable waves by utilizing the novel wave generating apparatuses disclosed herein.

BRIEF DESCRIPTION OF THE SEVERAL VIEWS OF THE DRAWING

These, as well as other features of the present invention, will become more apparent upon reference to the drawings wherein.

DETAILED DESCRIPTION OF THE INVENTION

The detailed description as set forth below in connection with the appended drawings is intended as a description of the presently preferred embodiments of the present invention, and is not intended to represent the only form in which the present invention may be constructed or utilized. The description sets forth the functions and sequences of steps for constructing and operating the invention in connection with the illustrated embodiments. It is understood, however, that the same or equivalent functions and sequences may be accomplished by different embodiments and that they are also intended to be encompassed within the scope of this invention.

Figure 1:
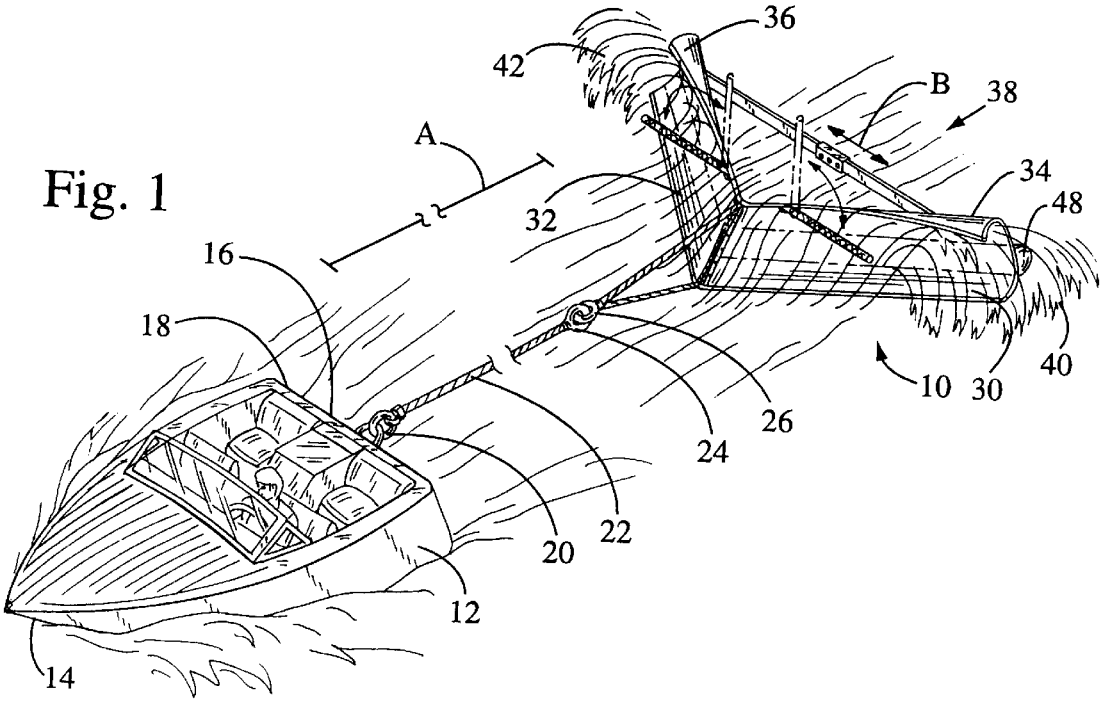
FIG. 1 is an elevated, perspective view of a conventional speedboat advancing through a body of water and towing a surfable wave generating apparatus, the latter being constructed in accordance to a first preferred embodiment of the present invention.

Referring now to the drawings, and initially to FIG. 1, there is shown a surfable wave generating apparatus 10 constructed in accordance with a first preferred embodiment of present invention. As illustrated, the apparatus 10 comprises a buoyant hull member formed by elongate arms or beam members 30, 32 that cooperate to define a generally chevron-like shape. The apparatus 10 is configured to be towed behind speedboat 12, or other similar-type watercraft, via a conventional rope connection. In this regard, it is contemplated that existing rope connection devices, such as eyelet 20 formed upon the transom 18 of the speedboat 12, may be easily and readily utilized to attach an elongate cord, such as nylon rope, whereby the distal end 24 thereof may be utilized to affix, and hence tow, the apparatus 10.

Contrary to such conventional applications, however, it should be recognized that in the practice of the present invention that the distance, as represented by the letter A, from which the device 10 of the present invention extends from speedboat 12 should at a minimum be 100 ft. and preferably greater than 120 ft.–150 ft. In this respect, it has been found that the wakes generated by most conventional speedboats such as 12, and in particular the wake formed by the bow 14 of such speedboat 12 and the motor 16 of such boat, sufficient distance must be provided to enable such distortions made within the body of water to flatten-out just prior to when the apparatus 10 is caused to plow therethrough and generate waves 40, 42. Advantageously, because the wave generating apparatus 10 of the present invention performs optimally under such conditions (i.e., generally flat, non-choppy waters), such apparatus 10 may be readily utilized in smaller bodies of water, such as lakes and rivers, which would not otherwise generate surfable waves via the natural forces of wind and gravity.

Figure 2:
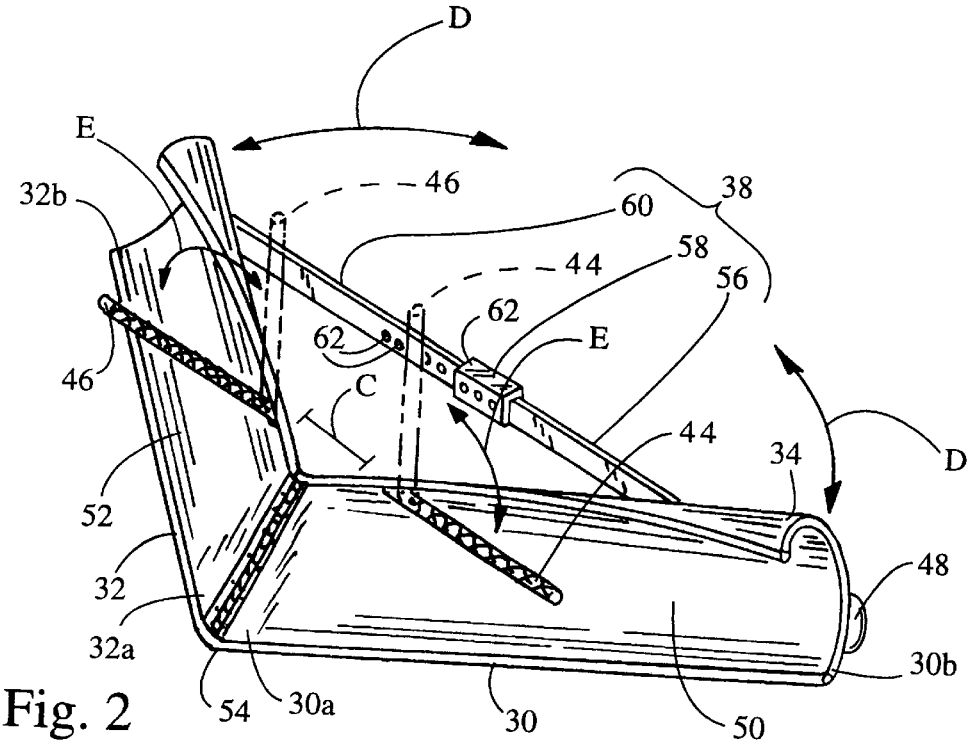
FIG. 2 is an elevated, perspective view of the surfable wave generating apparatus depicted in FIG. 1 assuming a first, operative configuration.

In order to facilitate the formation of waves that are most ideally suited for surfing, there is more clearly depicted in FIG. 2 the contours of the beam members 30, 32 which define the chevron-like configuration. As illustrated, each respective beam member 30, 32 is provided with a proximal end 30*a*, 32*a* and a distal end 30*b*, 32*b*, respectively.

At the proximal-most ends 30*a*, 32*a*, the respective sidewalls 50, 52 have a contoured, upwardly-sloping oblique configuration. Such contoured configuration is preferably provided such that in use, when the apparatus 10 is advanced through a given body water, a portion of the water contacted with the apparatus 10 is caused to spill over along a top portion of beam members 30, 32 as depicted in FIG. 1.

Preferably, such portion of water will be caused to spill over adjoining beams 30, 32 along the point defining the tip of the chevron, as indicated by the distance C in FIG. 2. As will be appreciated by those skilled in the art, by providing for a partial flow of water over the central-most portion of the apparatus 10 of the present invention not only facilitates the ability of such apparatus 10 to move through a given body of water, but further enhances the ability of the apparatus 10 to generate waves having a substantially tubular configuration, which is well-regarded as being most optimal for surfing.

Figure 4:
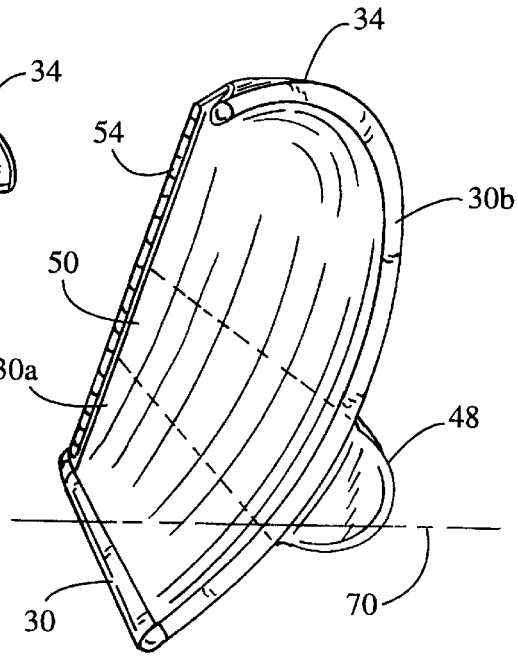
FIG. 4 is a perspective side view of a first elongate beam section as incorporated into the surfable wave generating apparatus depicted in FIG. 2.

To further facilitate the formation of such waves, such sidewall portions 50, 52 are formed to become progressively more concave and tubular as the same extend from the respective proximal ends 30*a*, 32*a* to distal ends 30*b*, 32*b* of beam member 30, 32, as illustrated in FIG. 4. In a more highly preferred embodiment, there is further formed upon each respective beam member 30, 32 a tapered, inwardly-curved sidewall portion 34, 36 that projects along the top peripheral edge of each respective beam member 30, 32. As illustrated, because of the increased curvature of the sidewall portions 50, 52 along the length of beam members 30, 32, the water flowing thereacross is thus caused to become progressively more curved and tubular in nature, as is desired.

To further facilitate the stability and buoyancy of the device 10 of the present invention, each respective elongate beam 30, 32 is preferably provided with a floatation member or pontoon 48 extending across the rear portion thereof. Preferably, such floatation member or pontoon 48 will rest just above the surface of the water 70, as depicted in FIG. 4, such that only a portion of the bottom peripheral edge of each respective elongate beam 30, 32 is submerged in the water when not in use.

As will be appreciated by those skilled in the art, the apparatus 10 of the present invention may be fabricated as a unitary piece of molded material, such as fiberglass and the like or, as illustrated, may be formed from separate beam members 30, 32 that are attached to one another via a hinge 54 at the proximal-most ends thereof 30*a*, 32*a*. By virtue of the attachment of the elongate beam 30, 32, via hinge 54, each respective elongate beams 30, 32 may rotate at a generally circular path indicated by the letter D. In use, when it becomes necessary to rigidly maintain the elongate beams 30, 32 in the operative chevron-shaped configuration as shown in FIGS. 1 and 2, a locking mechanism 38 is provided to rigidly maintain the elongate beams 30, 32 into position relative one another such that the same may define and maintain a specified angle which preferably ranges from 0° to 180°, with 90° being most preferred for generating surfable waves.

In the embodiment shown, such locking mechanism 38 comprises first and second bar members 56, 60 that are selectively connectable to one another via a bracket member 58. In this regard, it is contemplated that apertures 62 formed upon a respective one of the support bars 60 and the bracket member 58 may be aligned with one another and a locking pin (not shown) may be extended and secured therethrough. It will be recognized, however, that the locking mechanism 38 depicted is but one of a variety of systems well-known to those skilled in the art that may be deployed in the practice of the present invention.

Figure 3:
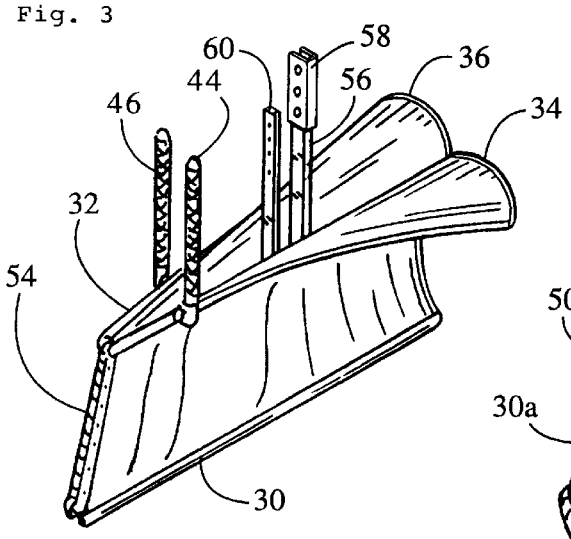
FIG. 3 is an elevated, perspective view of the surfable wave generating apparatus depicted in FIG. 2 assuming a second, collapsed configuration.

Advantageously, by providing for such configuration, the apparatus 10 of the present invention may thus be caused to selectively transition between its operative configuration, shown in FIGS. 1 and 2, to a compact configuration, depicted in FIG. 3, whereby the support bars 56, 60 and bracket member 58 may be detached from one another to thus enable the elongate beams 30, 32 to rotate inwardly toward one another, as shown. As will be recognized by those skilled in the art, such configuration facilitates the storage and handling of the device 10 of the present invention. In this respect, it is contemplated that when in such compact configuration, the device 10 of the present invention may be readily mounted and towed upon a trailer and pulled behind a vehicle.

As an option, the surfable wave generating apparatus 10 of the present invention may further be provided with handle members 44, 46 disposed upon opposed sides of the elongate beams 30, 32, as shown in FIG. 2, such that the same extend at a generally perpendicular configuration relative the direction of tow. In this regard, it is contemplated that when the device 10 of the present invention is towed through the water, a surfer may be able to grasp a respective handle 44, 46 and be towed just in front a respective elongate beam 30, 32 until such time as surfer decides to ride upon the wave generated thereby. In this respect, upon releasing the handle member 44, 46, the surfer will be propelled forward upon the wave generated from the forward-facing surface of the respective elongate beam 30, 32, as traditionally occurs in surfing. To facilitate storage and handling of the device 10 of the present invention, it is contemplated that such handle members 44, 46 may be pivotally mounted upon elongate beams 30, 32 such that the same may rotate upwardly in the direction indicated by the letter E. As will be appreciated, by positioning the handles 44, 46 upwardly, as depicted in FIG. 3, the device will thus be able to assume a more compact, aerodynamic configuration when not in use.

Figure 5:
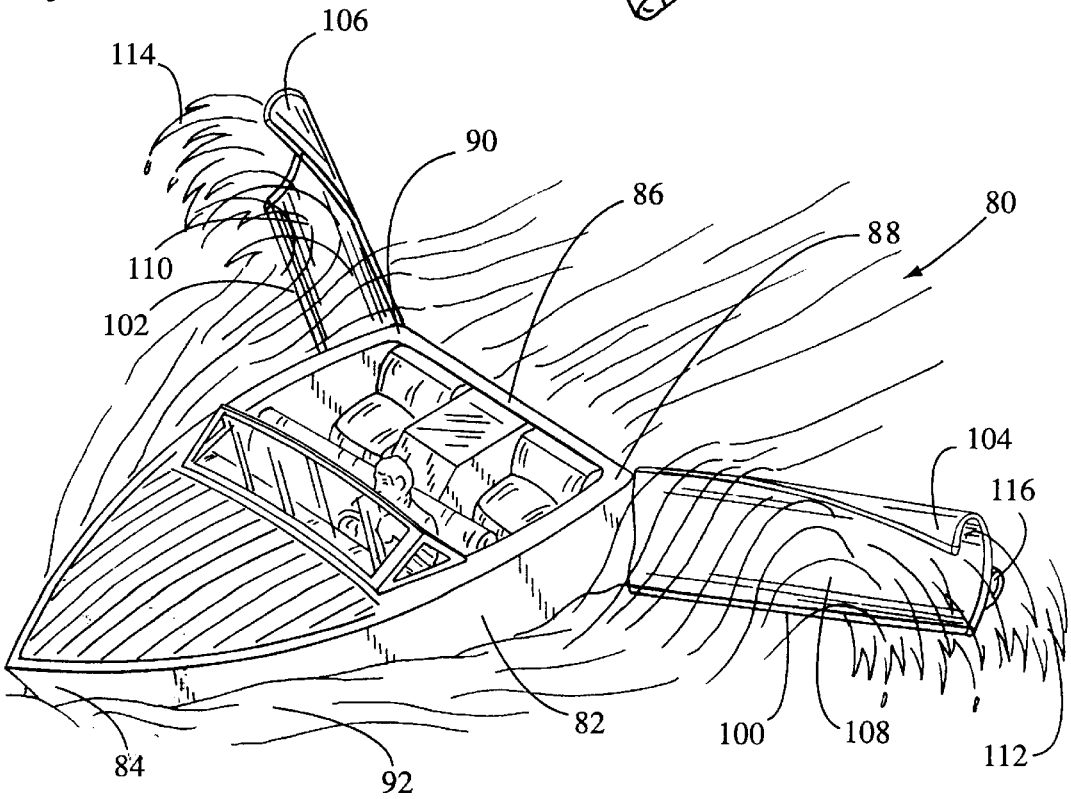
FIG. 5 is an elevated, perspective view of a conventional speedboat having a surfable wave generating apparatus attached thereto, the latter being constructed in accordance with a second preferred embodiment of the present invention.

Referring now to FIG. 5, there is shown a wave generating apparatus 80 constructed in accordance to a second preferred embodiment of the present invention. As illustrated, such embodiment incorporates the use of first and second elongate beams 100, 102 that, as per the first embodiment, are provided with contoured, forward-facing sidewalls 108, 110 that, when advanced through the water, cause a portion of the water flowing there against to form a tubular wave 112, 114 which can be surfed upon. As per the first embodiment, each respective elongate beam 100, 102 is preferably provided with a tapered, inwardly-curved sidewall portion 104, 106 that facilitates the formation of generally tubular-shaped waves. Each respective elongate beam 100, 102 may further preferably be provided with an elongate floatation device or pontoon, such as 116, to provide such members 100, 102 with sufficient buoyancy.

Although one or both beams 100, 102 may be positioned anywhere upon the boat, it is preferred that such elongate beams 100, 102 be mounted upon the stern portion 86 of the boat upon either the port and starboard sides 88, 90, respectively, or the transom of such boat 82. Preferably, the elongate beams 100, 102 are formed to extend rearwardly from the bow 84 of the boat 82 in a generally diagonal fashion. Preferably, each respective elongate beam 100, 102 is detachably fastenable upon the speedboat 82, the latter which may comprise any of a variety of conventional, motor-driven watercraft.

With respect to generating waves by the device of the present invention, although readily apparent, it will be recognized that the user need only drive the speedboat with beams 100, 102 attached thereto in close proximity to where it is desired to surf. By merely passing through the water, each respective elongate beam 100, 102 consequently causes water to flow across the sidewall pontoons 108, 100 thereof such that the waves 112, 114 are produced thereby. As per the first embodiment, each elongate beam 100, 102 is preferably formed such that at least a portion of the water 92 flowing there against flows over such beam member 100, 102 about the proximal-most ends thereof.

Although the invention has been described herein with specific reference to a presently preferred embodiment thereof, it will be appreciated by those skilled in the art that various modifications, deletions, and alterations may be made to such preferred embodiment without departing from the spirit and scope of the invention. Accordingly, it is intended that all reasonably foreseeable additions, modifications, deletions and alterations be included within the scope of the invention as defined in the following claims.

I claim:

1. An apparatus for generating surfable waves when towed within a body of water comprising a buoyant hull member having a general chevron shape comprised of first and second elongate beam members having proximal and distal ends, said elongate beams being connected to one another at the proximal ends thereof to define the point of said chevron, said hull member having first and second concave, forward-facing surfaces formed thereon oriented to plow through the water's surface such that water is causes to flow respectively thereacross and form dedicated surfable waves thereby, said apparatus further including at least one handle member formed upon at least one elongate beam of said hull member.

2. The apparatus in claim 1 wherein said hull member is comprised of first and second elongate beam members having proximal and distal ends, said elongate beams being connected to one another at the proximal ends thereof to define the point of said chevron.

3. The apparatus in claim 2 wherein said first and second elongate beam members are connected at the proximal ends thereof via a hinge such that each respective beam member may rotate about a central axis.

4. The apparatus in claim 3 wherein said hull member further comprises a locking mechanism for selectively and controllably maintaining said first and second elongate beam members rigidly in fixed position relative one another such that said elongate beam members cooperate to define a specified angle.

5. The apparatus in claim 4 wherein said locking mechanism rigidly maintains said first and second elongate members into fixed position relative one another such that said elongate members cooperate to define an angle ranging from 0°–180°.

6. The apparatus in claim 1 wherein said forward-facing surface of said hull member comprises first and second contoured sidewall portions having proximal and distal ends and formed as mirror-images of one another, said proximal ends of said sidewall portions having an upwardly sloping oblique surface that become progressively concave as said sidewall portions extend from said proximal ends to said distal ends.

7. The apparatus in claim 6 wherein said sidewall portions further include tapered, inwardly curved sidewall portions formed upon the uppermost peripheral edges thereof and extending toward the distal ends of said sidewall.

8. The apparatus in claim 2 wherein said apparatus includes a floatation member formed thereon.

9. The apparatus in claim 8 wherein said floatation member comprises at least one pontoon.

10. The apparatus in claim 9 wherein said apparatus is provided with first and second elongate pontoons formed upon respective ones of said pair of elongate beams.

11. The apparatus in claim 1 wherein said apparatus includes at least one handle member formed upon each respective one of said first and second elongate beams of said hull member.

12. The apparatus in claim 11 wherein each respective handle is pivotally mounted upon each respective beam such that each respective handle can selectively transition between a first operative, graspable configuration and a compact, non-operative configuration.

13. A method for generating a surfable wave upon a body of water comprising:

a) providing a body of water, speedboat and an apparatus for generating a surfable wave when towed within a body of water wherein said apparatus comprises a buoyant hull member having a generally chevron shape comprised of first and second elongate beam members having proximal and distal ends, said elongate beams being connected to one another at the proximal ends thereof via a hinge such that each respective beam member may rotate about a central axis, said hull member further comprising a locking mechanism for selectively and controllably maintaining said first and second elongate beam members rigidly in fixed position relative one another such that said elongate beam members cooperate to define a specified angle, said hull member having a concave forward-facing surface oriented to plow through the water's surface such that water is caused to flow thereacross and form said wave; and b) towing said apparatus for generating a surfable wave with said speedboat across said body of water.

14. An apparatus for generating a surfable wave from a speedboat within a body of water comprising at least one elongate beam having proximal and distal ends attachable to said speedboat, said at least one elongate beam having at least one pontoon formed thereon and a generally concave forward-facing surface oriented to plow through the water's surface such that water is caused to flow thereacross and form said wave.

15. The apparatus in claim 14 wherein said forward-facing surface of said beam member comprises a contoured sidewall portion having proximal and distal ends, said proximal end of said sidewall having an upwardly sloping oblique surface that becomes progressively concave as said sidewall extends from said proximal end to said distal end.

16. The device in claim 14 wherein said apparatus comprises first and second elongate beam members.

17. The apparatus in claim 16 wherein a respective one of said pair of beam members is attachable to the port side of said speedboat and the respective other beam member is attachable to the starboard side of said speedboat.

18. The apparatus in claim 16 wherein both said respective beam members are attachable to the transom of said boat.

19. The apparatus in claim 16 wherein each respective one of said pair of elongate beams extend rearward from said boat in a generally diagonal fashion.

20. The apparatus in claim 16 wherein said apparatus is provided with first and second elongate pontoons formed upon respective ones of said first and second elongate beams.

21. A method for generating a surfable wave upon a body of water comprising:

a) providing a body of water, speedboat and an apparatus for generating a surfable wave within the body of water when towed therethrough, said apparatus comprising at least one elongate beam having at least one pontoon formed thereon and a generally concave, forward-facing surface oriented to plow through the water's surface and form said wave;

b) attaching said elongate beam to said speedboat; and c) towing said elongate beam with said speedboat across said body of water.

22. An apparatus for generating surfable waves when towed within a body of water comprising a buoyant hull member comprised of first and second elongate beam members having proximal and distal ends, said elongate beams being connected to one another at the proximal ends thereof via a hinge such that each respective beam member may rotate about a central axis, said hull member further comprising a locking mechanism for selectively and controllably maintaining said first and second elongate beam members rigidly in fixed position relative one another such that said elongate beam members cooperate to define a specified angle.

23. The apparatus of claim 22 wherein said locking mechanism rigidly maintains said first and second elongate members into fixed position relative one another such that said elongate members cooperate to define an angle ranging from zero degrees to one hundred and eighty degrees.

24. An apparatus for generating surfable waves when towed within a body of water comprising a buoyant hull member comprised of first and second elongate beam members having proximal and distal ends, said elongate beams being connected to one another at the proximal ends thereof to define a generally chevron shape, said hull member further including at least one pontoon and forward-facing surfaces oriented to plow through the water surface such that the water is caused to flow respectively thereacross and formed dedicated surfable waves thereby.

* * * * *